US010395608B2

(12) United States Patent
Chen

(10) Patent No.: US 10,395,608 B2
(45) Date of Patent: Aug. 27, 2019

(54) METHOD AND DEVICE FOR IMPROVING LCD LARGE VIEWING ANGLE DISPLAY EFFECT

(71) Applicant: Shenzhen China Star Optoelectronics Technology Co., Ltd., Shenzhen, Guangdong (CN)

(72) Inventor: Lixuan Chen, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 216 days.

(21) Appl. No.: 15/500,107

(22) PCT Filed: Jan. 18, 2017

(86) PCT No.: PCT/CN2017/071484
§ 371 (c)(1),
(2) Date: Jan. 30, 2017

(87) PCT Pub. No.: WO2018/040485
PCT Pub. Date: Mar. 8, 2018

(65) Prior Publication Data

US 2019/0005899 A1 Jan. 3, 2019

(30) Foreign Application Priority Data

Aug. 29, 2016 (CN) ..... 2016 1 0752869

(51) Int. Cl.
*G09G 3/36* (2006.01)

(52) U.S. Cl.
CPC ..... *G09G 3/3607* (2013.01); *G09G 3/36* (2013.01); *G09G 2320/028* (2013.01); *G09G 2320/0247* (2013.01)

(58) Field of Classification Search
CPC ..... G09G 2320/028; G09G 3/3607; G09G 2320/0247
See application file for complete search history.

(56) References Cited

U.S. PATENT DOCUMENTS

2003/0006952 A1* 1/2003 Hong ..... G09G 3/3648 345/89
2003/0184570 A1 10/2003 Chen
(Continued)

FOREIGN PATENT DOCUMENTS

CN 1727946 A 2/2006
CN 101894520 11/2010
(Continued)

OTHER PUBLICATIONS

International Search Report dated May 26, 2017 for International Patent Application No. PCT/CN2017/071484.
(Continued)

*Primary Examiner* — Hong Zhou

(57) ABSTRACT

Disclosed are a method and a device for improving an LCD large viewing angle display effect. The method includes: detecting an input RGB gray-scale voltage, when the input RGB gray-scale voltage meets a given preset condition, performing by a display panel an H/L switching display of two frames, and when the input RGB gray-scale voltage does not meet the given preset condition, performing by the display panel a normal display of two frames, wherein the given preset condition is: $80\%*R_{specification} \leq R \leq 120\%*R_{specification}$, $80\%*G_{specification} \leq G \leq 120\%*G_{specification}$ or $80\%*B_{specification} \leq B \leq 120\%*B_{specification}$.

2 Claims, 6 Drawing Sheets

(56) References Cited

U.S. PATENT DOCUMENTS

| | | | | |
|---|---|---|---|---|
| 2014/0118423 | A1* | 5/2014 | Hasegawa | G09G 3/2003<br>345/690 |
| 2015/0170597 | A1* | 6/2015 | Shin | G09G 3/3685<br>345/212 |
| 2016/0210911 | A1* | 7/2016 | Chen | G09G 3/3607 |

FOREIGN PATENT DOCUMENTS

| | | | |
|---|---|---|---|
| CN | 102427517 | A | 4/2012 |
| CN | 104485077 | A | 4/2015 |
| CN | 104620309 | A | 5/2015 |
| CN | 104900209 | A | 9/2015 |
| CN | 105096852 | A | 11/2015 |
| CN | 105528999 | A | 4/2016 |
| CN | 106205533 | A | 12/2016 |
| KR | 20030008044 | A | 1/2003 |
| KR | 20160085387 | A | 7/2016 |

OTHER PUBLICATIONS

Chinese Office Action dated Mar. 30, 2018 for Chinese Patent Application No. 201610752869.0.

* cited by examiner

METHOD AND DEVICE FOR IMPROVING LCD LARGE VIEWING ANGLE DISPLAY EFFECT

CROSS-REFERENCE TO RELATED APPLICATIONS

This application claims the priority of Chinese patent application CN201610752869.0, entitled "Method and Device for Improving LCD Large Viewing Angle Display Effect" and filed on Aug. 29, 2016, the entirety of which is incorporated herein by reference.

FIELD OF THE INVENTION

The present disclosure relates to the display technical field, and in particular, to a method and a device for improving an LCD large viewing angle display effect.

BACKGROUND OF THE INVENTION

In recent years, the display technology has developed rapidly, and the flat panel display device has replaced the bulky CRT display device and has become increasingly popular in people's daily life. At present, the commonly used flat display device includes a liquid crystal display (LCD) device and an organic light emitting diode (OLED) display device. The flat display device has the characteristics of small size, low power consumption, no radiation, etc., and occupies a dominant position in the current flat display device market.

Since the OLED technology is not yet mature, the current mainstream flat display device is still LCD. According to the LCD display type, it can be divided into: TN type, VA type, IPS type and FFS type. As far as the viewing angle is concerned, the VA, IPS and FFS types are better than the TN type, and a TN-type display screen with a narrow viewing angle is mainly used for NB and other mobile office products. In the existing display products, the viewing angle is fixed and single, and cannot meet the requirements of different application places and viewing preferences. Therefore, it is necessary to provide a display device with a switchable viewing angle.

In the MVA LCD display device, the large viewing angle image is easy to produce a large viewing angle light leakage and wash out phenomenon due to uneven cell gaps. A lot of solutions are proposed in the industry to improve this large viewing angle display effect, such as multi-domain, 1G1D coupling and 2D1G technologies. In the 2D1G technology, it is possible to provide signals for the Main pixels and the Sub pixels, respectively, which leads to the possibility of improving the large viewing angle display effect by using different gamma curves.

However, the 2D1G technology will bring the problem of decrease of a penetration rate, and thus the display effect and the penetration rate of an image under the large viewing angle cannot be taken into account at the same time.

For example, Chinese patent application CN201510344787.8 describes a method for improving an LCD large viewing angle display effect. This method combines the LCS transformations of time and space signal processing to achieve a good large viewing angle improvement effect in 4 domains. However, due to the reasons that the drive frequency is not high enough (120 to 240 Hz), the liquid crystal response is not fast enough, and the gray-scale difference between two frames during switching is too large, and so on, the flicker phenomenon is sometimes observed in the picture.

During the design of the time and space mixed 4 domains to alleviate the color shift at a large viewing angle, there are two problems that cannot be avoided:

(1) the problem that the decrease of a spatial resolution leads to the loss of the resolution in the details of the picture;

(2) the problem that the decrease of a time resolution leads to the flicker in switching of light and dark pictures.

In actual situation, if the brightness difference between two frames of one same sub-pixel is too large, the possibility of generating a flicker phenomenon will be increased. Considering that the general distribution form of H/L signals is generally roughly like the contour of the curve as shown in FIG. 3, the maximum gray-scale difference position of H/L is in the vicinity of 150 to 170 gray scales, while the maximum brightness difference position has a slightly higher gray scale than the maximum gray-scale difference position.

Therefore, in order to solve the existing technical problem that the display effect and the penetration rate of the image under the large viewing angle in the MVA LCD display device cannot be taken into account at the same time, the technical solution of the present disclosure is proposed.

SUMMARY OF THE INVENTION

In view of the above-mentioned problems in the prior art, the present disclosure proposes a method and a device for improving an LCD large viewing angle display effect.

The method for improving an LCD large viewing angle display effect comprises the following steps, as shown in FIG. 1:

S100: inputting an RGB gray-scale voltage;

S101: determining by a signal detection and determination module;

S102: when the input RGB gray-scale voltage meets a given preset condition, performing by a display panel an H/L switching display of two frames, wherein the given preset condition is: any one of $80\%*R_{specification} \leq R \leq 120\%*R_{specification}$, $80\%*G_{specification} \leq G \leq 120\%*G_{specification}$ and $80\%*B_{specification} \leq B \leq 120\%*B_{specification}$ constitutes a first preset mode, wherein, $R_{specification}$ is a preset red gray-scale voltage threshold; $G_{specification}$ is a preset green gray-scale voltage threshold; $B_{specification}$ is a preset blue gray-scale voltage threshold; R is an input red gray-scale voltage; G is an input green gray-scale voltage; and B is an input blue gray-scale voltage;

S103: when the input RGB gray-scale voltage does not meet the given preset condition, performing by the display panel a normal display of two frames, wherein the given preset condition is: any one of $80\%*R_{specification} \leq R \leq 120\%*R_{specification}$, $80\%*G_{specification} \leq G \leq 120\%*G_{specification}$ and $80\%*B_{specification} \leq B \leq 120\%*B_{specification}$ constitutes a first preset mode;

S104: outputting the RGB gray-scale voltage.

It is further defined that the given preset condition is: $80\%*R_{specification} \leq R \leq 120\%*R_{specification}$ and $80\%*G_{specification} \leq G \leq 120\%*G_{specification}$ constitute a second preset mode.

It is further defined that the given preset condition is: $80\%*R_{specification} \leq R \leq 120\%*R_{specification}$ and $80\%*B_{specification} \leq B \leq 120\%*B_{specification}$ constitute a third preset mode.

It is further defined that the given preset condition is: $80\%*G_{specification} \leq G \leq 120\%*G_{specification}$ and $80\%*B_{specification} \leq B \leq 120\%*B_{specification}$ constitute a fourth preset mode.

It is further defined that the given preset condition is: $80\%*R_{specification} \leq R \leq 120\%*R_{specification}$ and $80\%*G_{specification} \leq G \leq 120\%*G_{specification}$ and $80\%*B_{specification} \leq B \leq 120\%*B_{specification}$ constitute a fifth preset mode.

The device for improving an LCD large viewing angle display effect comprises:

a voltage detecting unit, configured to detect an input RGB gray-scale voltage; and a switching display determination unit, configured to determine the input RGB gray-scale voltage so that when the input RGB gray-scale voltage meets a given preset condition, a display panel performs an H/L switching display of two frames, and when the input RGB gray-scale voltage does not meet the given preset condition, the display panel performs a normal display of two frames, wherein the given preset condition is: any one of $80\%*R_{specification} \leq R \leq 120\%*R_{specification}$, $80\%*G_{specification} \leq G \leq 120\%*G_{specification}$ and $80\%*B_{specification} \leq B \leq 120\%*B_{specification}$ constitutes a first preset mode, wherein, $R_{specification}$ is a preset red gray-scale voltage threshold; $G_{specification}$ is a preset green gray-scale voltage threshold; $B_{specification}$ is a preset blue gray-scale voltage threshold; R is an input red gray-scale voltage; G is an input green gray-scale voltage; and B is an input blue gray-scale voltage.

It is further defined that the given preset condition in the device is: $80\%*R_{specification} \leq R \leq 20\%*R_{specification}$ and $80\%*G_{specification} \leq G \leq 120\%*G_{specification}$ constitute a second preset mode.

It is further defined that the given preset condition in the device is: $80\%*R_{specification} \leq R \leq 120\%*R_{specification}$ and $80\%*B_{specification} \leq B \leq 120\%*B_{specification}$ constitute a third preset mode.

It is further defined that the given preset condition in the device is: $80\%*G_{specification} \leq G \leq 120\%*G_{specification}$ and $80\%*B_{specification} \leq B \leq 120\%*B_{specification}$ constitute a fourth preset mode.

It is further defined that the given preset condition in the device is: $80\%*R_{specification} \leq R \leq 120\%*R_{specification}$ and $80\%*G_{specification} \leq G \leq 120\%*G_{specification}$ and $80\%*B_{specification} \leq B \leq 120\%*B_{specification}$ constitute a fifth preset mode.

The method or the device for improving an LCD large viewing angle display effect can be used in the design of a blue laser communication device, or in the design of a single or combined H/L switching of R/G/B display device. This method and device can effectively avoid the loss of the resolution caused by the space H/L switching technology, and can also alleviate the undesirable flicker caused by the time H/L switching.

The present disclosure provides a method for improving an LCD large viewing angle display effect. The method comprises a step of detecting an input RGB gray-scale voltage, and when the input RGB gray-scale voltage meets any preset condition, a display panel performs an H/L switching display of two frames; when the input RGB gray-scale voltage does not meet the preset condition, the display panel performs a normal display of two frames, wherein the preset condition is: $80\%*R_{specification} \leq R \leq 120\%*R_{specification}$, $80\%*G_{specification} \leq G \leq 120\%*G_{specification}$ or $80\%*B_{specification} \leq B \leq 120\%*B_{specification}$.

The present disclosure has the following beneficial effects. As to a display device with 120 Hz or a higher drive frequency, when in the time-space mixed or time H/L switching, by distinguishing the input signal of each sub-pixel, it is possible to effectively discriminate between the pattern that needs to be switched and the pattern that does not need to be switched, and to alleviate the flicker phenomenon appearing on part of the picture. The present disclosure can be applied to a VA type LCD to achieve the purpose of alleviating a color shift at a large viewing angle by improving the LCS of the time transformation, while reducing the loss of the penetration rate.

The technical features described above may be combined in various suitable ways or may be replaced by equivalent technical features as long as the object of the present disclosure can be achieved.

BRIEF DESCRIPTION OF THE DRAWINGS

The present disclosure will be described in a more detailed way below based on embodiments and with reference to the accompanying drawings, in the drawings.

In the accompanying drawings, same components use same reference signs. The accompanying drawings are not drawn according to actual proportions.

DETAILED DESCRIPTION OF THE EMBODIMENTS

The prior art discloses that sub-pixels in a predetermined region of a liquid crystal panel are driven by a cycle of M successive frames, wherein the polarities of the sub-pixel driving voltages of the successive first predetermined number of frames in the M frames are same, and the polarity of the sub-pixel driving voltage of each frame other than the first predetermined number of frames in the M frames is opposite to the polarity of the sub-pixel driving voltage of an adjacent frame.

The present disclosure describes a method for improving an LCD large viewing angle display effect. This method combines the LCS transformations of time and space signal processing to achieve a good large viewing angle improvement effect in 4 domains. However, due to the reasons that the drive frequency is not high enough (120 to 240 Hz), the liquid crystal response is not fast enough, and the gray-scale difference between two frames during switching is too large, and so on, the flicker phenomenon is sometimes observed in the picture. Thus, in the prior art, it is known that the large viewing angle display effect can be improved by time signal transformation. That is, at a higher frequency, one frame displays the signal of BL (GL/RL), and the other frame displays the signal of BH (RH/GH).

Figure 1:
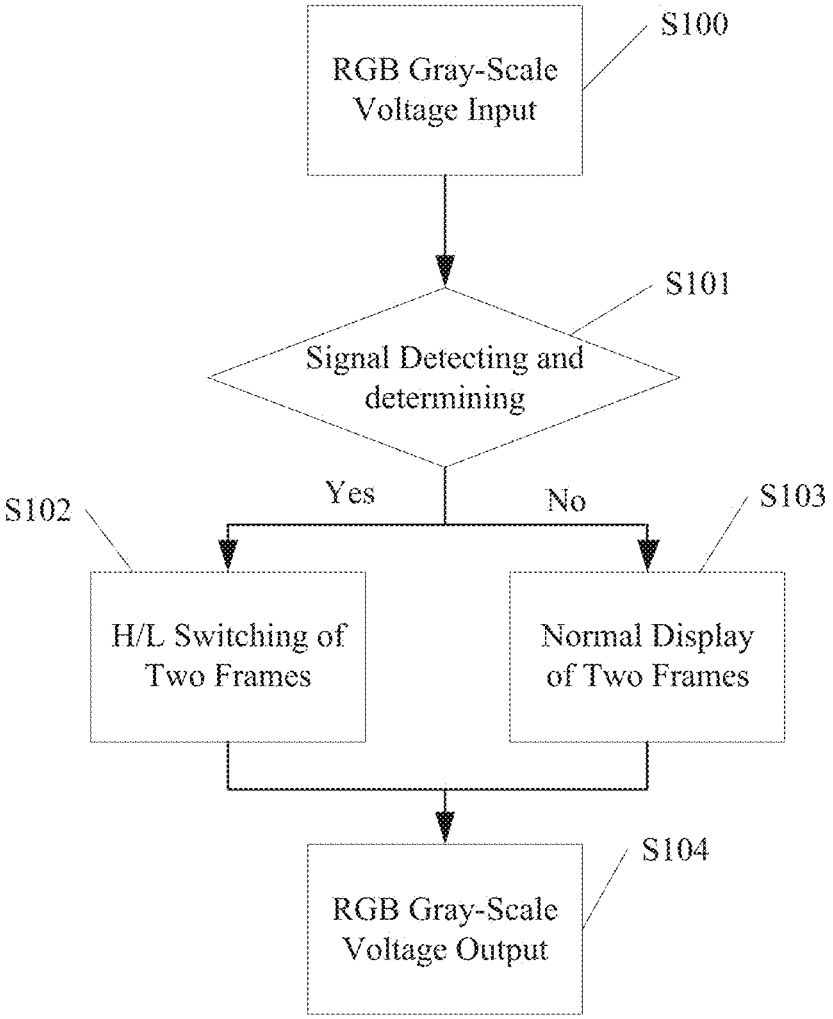
FIG. 1 is a flow chart of a method for improving an LCD large viewing angle display effect according to the present disclosure.
Figure 2:
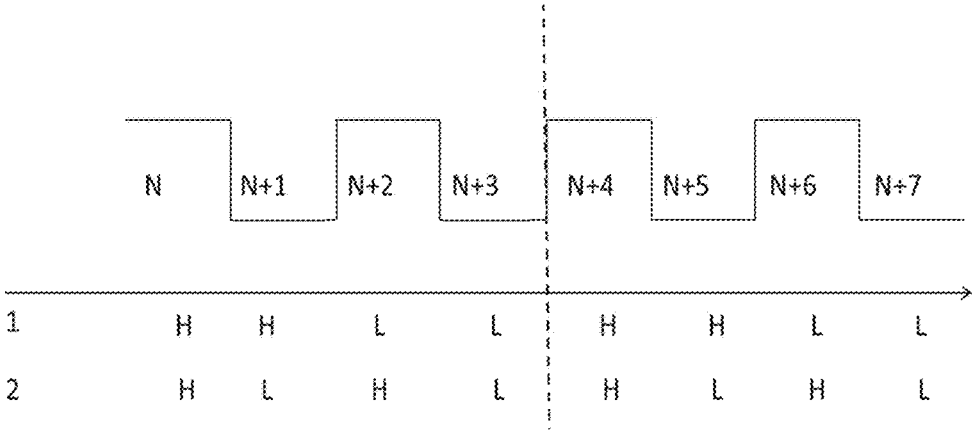
FIG. 2 is a sub-pixel signal design method for a frame switching, wherein "1" represents one frame signal; "2" represents another frame signal; H represents a high gray scale; and L represents a low gray scale.

However, during the design of the time and space mixed 4 domains to alleviate the color shift at a large viewing angle, there are two problems that cannot be avoided, i.e., (1) the problem that the decrease of a spatial resolution leads to the loss of the resolution in the details of the picture;

(2) the problem that the decrease of a time resolution leads to the flicker in switching of light and dark pictures (referring to FIG. 2 for detail).

Figure 3:
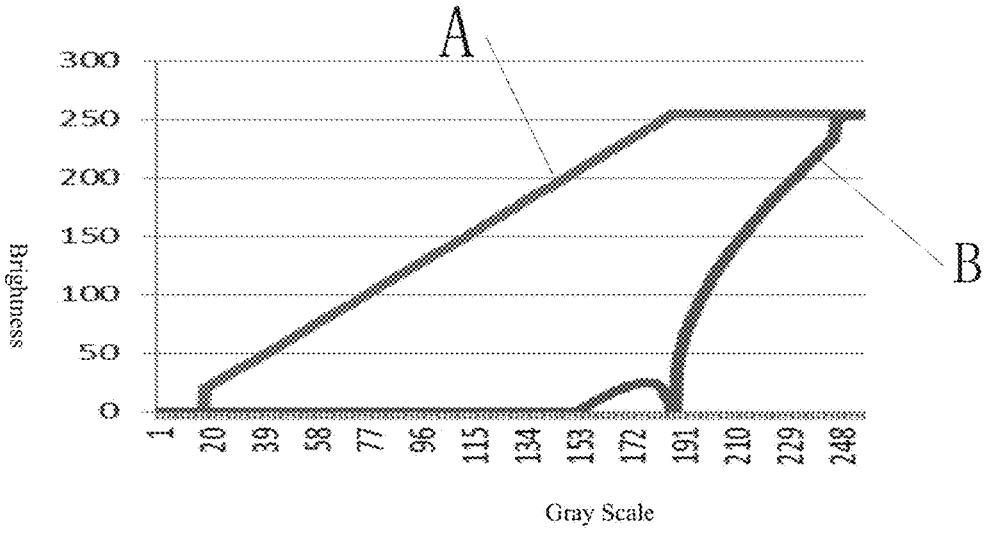
FIG. 3 is a general distribution form of H/L signals; reference sign A represents brightness corresponding to the high gray scale; reference sign B represents brightness corresponding to the low gray scale.

In actual situation, if the brightness difference between two frames of one same sub-pixel is too large, the possibility of generating a flicker phenomenon will be increased. Considering that the general distribution form of H/L signals is generally roughly like the contour of the curve as shown in FIG. 3, the maximum gray-scale difference position of H/L is in the vicinity of 150-170 gray scales, while the maximum brightness difference position has a slightly higher gray scale than the maximum gray-scale difference position.

In order to avoid the flicker phenomenon that may occur when brightness difference between two frames is large, the input images are distinguished. The present disclosure proposes the following solution.

Firstly, it proposes an image pattern, in which front viewing and side viewing will lead to great subjective difference perceptions obviously, and a series of matching values of their gray-scale R/G/B are listed, such as a 9 chromaticity viewing angle pattern in the national standard and a skin color pattern. The 9 chromaticity viewing angle pattern is shown in Table 1, and meanwhile it also includes other matching situations of R/G/B individually defined by the designer.

TABLE 1

| Serial | a) 0-255 Range Setting Occasion (Analog Interface Input) | | | b) 16-235 Range Setting Occasion (Digital Interface Input) | | | Color |
|---|---|---|---|---|---|---|---|
| Number | R | G | B | R | G | B | Sample |
| 1 | 115 | 82 | 68 | 115 | 87 | 74 | Dark Skin |
| 2 | 194 | 150 | 130 | 183 | 145 | 128 | Skin Light |
| 3 | 56 | 61 | 150 | 64 | 69 | 145 | Blue |
| 4 | 70 | 148 | 73 | 76 | 143 | 79 | Green |
| 5 | 175 | 54 | 60 | 166 | 62 | 68 | Red |
| 6 | 231 | 199 | 31 | 214 | 187 | 43 | Yellow |
| 7 | 187 | 86 | 149 | 177 | 90 | 143 | Magenta |
| 8 | 8 | 133 | 161 | 23 | 130 | 154 | Cyan |
| 9 | 122 | 122 | 121 | 121 | 121 | 120 | Gray |

Thus, for the above pattern, there are a series of specifications of R/G/B gray-scale matching, and in the input image signals, $$80\%*R_{specification} \leq R \leq 120\%*R_{specification} \quad (1),$$

$$80\%*G_{specification} \leq G \leq 120\%*G_{specification} \quad (2),$$

$$80\%*B_{specification} \leq B \leq 120\%*B_{specification} \quad (3),$$

when any one, any two or three of the above formulas (1), (2) and (3) are satisfied, the logic of the H/L switching is defined as True, that is, the display panel performs an H/L switching display of two frames; otherwise, it is defined as False, that is, the display panel performs a normal display of two frames.

For a display device with 120 Hz or a higher drive frequency, when in the time and space mixed or time H/L switching, by distinguishing the input signal of each sub-pixel, it is possible to effectively discriminate between the pattern that needs to be switched and the pattern that does not need to be switched, and to alleviate the flicker phenomenon appearing on part of the picture.

The method provided by the present disclosure can be applied to the design of a blue laser communication system, and can also be applied to the design of a single or combined H/L switching of R/G/B display device.

The method can also effectively avoid the loss of the resolution caused by the space H/L switching technology, and can also alleviate the flicker caused by the time H/L switching.

The present disclosure will be further described below in combination with the accompanying drawings.

Figure 4:
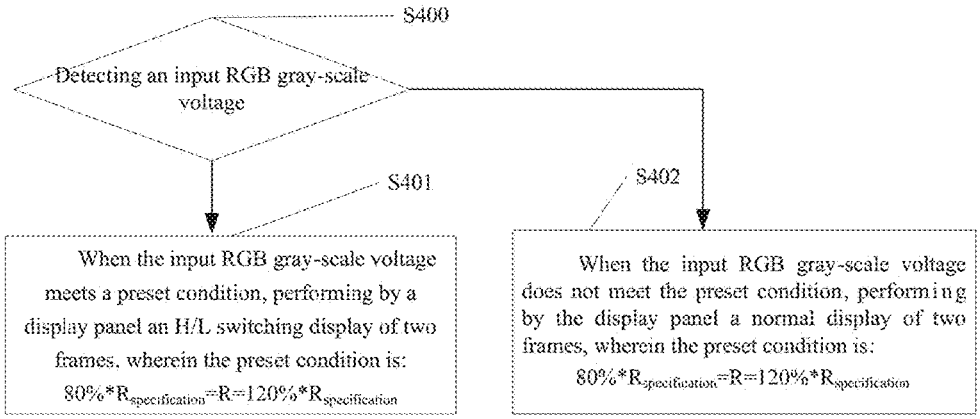
FIGS. 4-10 are all flow charts of a method for improving an LCD large viewing angle display effect according to the present disclosure.

In FIG. 4, a method for improving an LCD large viewing angle display effect is introduced. The method comprises the following steps.

In step S400, an input RGB gray-scale voltage is detected.

In step S401, when the input RGB gray-scale voltage meets any preset condition, a display panel performs an H/L switching display of two frames, wherein the preset condition is:

$$80\%*R_{specification} \leq R \leq 120\%*R_{specification},$$

where, $R_{specification}$ is a preset red gray-scale voltage threshold.

In step S402, when the input RGB gray-scale voltage does not meet the preset condition, the display panel performs a normal display of two frames, wherein the preset condition is:

$$80\%*R_{specification} \leq R \leq 120\%*R_{specification},$$

where, $R_{specification}$ is a preset red gray-scale voltage threshold.

Figure 5:
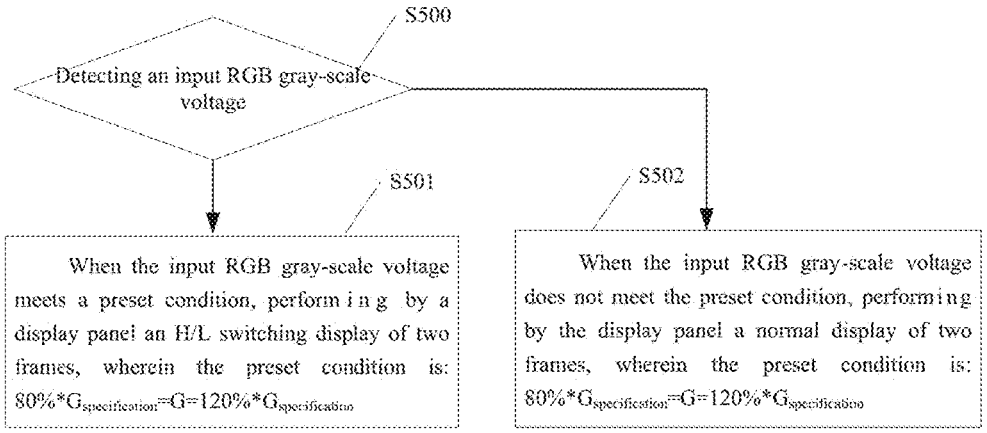

In FIG. 5, a method for improving an LCD large viewing angle display effect is introduced. The method comprises the following steps.

In step S500, an input RGB gray-scale voltage is detected.

In step S501, when the input RGB gray-scale voltage meets any preset condition, a display panel performs an H/L switching display of two frames, wherein the preset condition is:

$$80\%*G_{specification} \leq G \leq 120\%*G_{specification},$$

where, $G_{specification}$ is a preset green gray-scale voltage threshold.

In step S502, when the input RGB gray-scale voltage does not meet the preset condition, the display panel performs a normal display of two frames, wherein the preset condition is:

$$80\%*G_{specification} \leq G \leq 120\%*G_{specification},$$

where, $G_{specification}$ is a preset green gray-scale voltage threshold.

Figure 6:
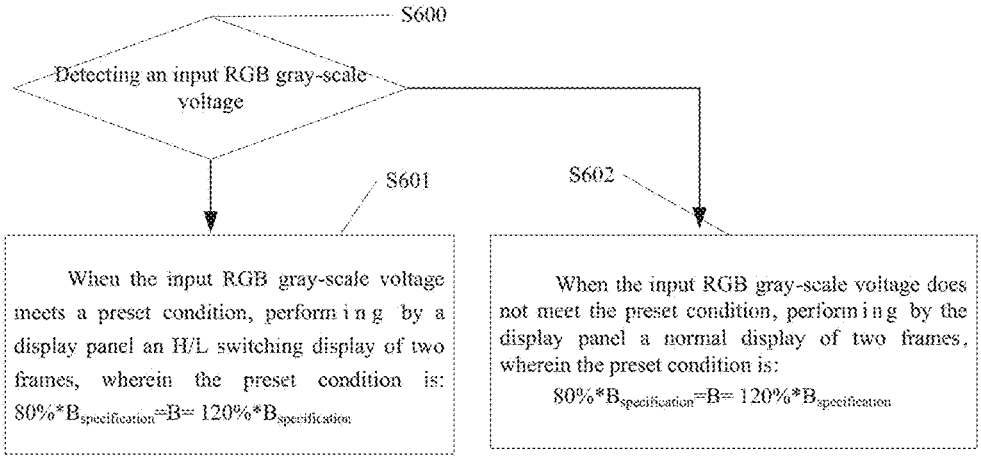

In FIG. 6, a method for improving an LCD large viewing angle display effect is introduced. The method comprises the following steps.

In step S600, an input RGB gray-scale voltage is detected.

In step S601, when the input RGB gray-scale voltage meets any preset condition, a display panel performs an H/L switching display of two frames, wherein the preset condition is:

$$80\%*B_{specification} \leq B \leq 120\%*B_{specification},$$

where, $B_{specification}$ is a preset blue gray-scale voltage threshold.

In step S602, when the input RGB gray-scale voltage does not meet the preset condition, the display panel performs a normal display of two frames, wherein the preset condition is:

$$80\%*B_{specification} \leq B \leq 120\%*B_{specification},$$

where, $B_{specification}$ is a preset blue gray-scale voltage threshold.

Figure 7:
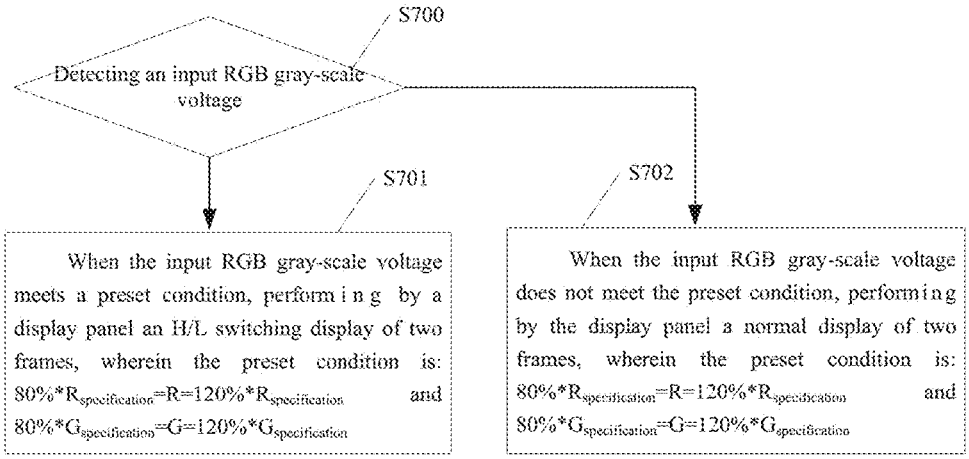

In FIG. 7, a method for improving an LCD large viewing angle display effect is introduced. The method comprises the following steps.

In step S700, an input RGB gray-scale voltage is detected.

In step S701, when the input RGB gray-scale voltage meets any preset condition, a display panel performs an H/L switching display of two frames, wherein the preset condition is:

$$80\%*R_{specification} \leq R \leq 120\%*R_{specification} \text{ and } 80\%*G_{specification} \leq G \leq 120*G_{specification},$$

where, $R_{specification}$ is a preset red gray-scale voltage threshold; and $G_{specification}$ is a preset green gray-scale voltage threshold;

In step S702: when the input RGB gray-scale voltage does not meet the preset condition, the display panel performs a normal display of two frames, wherein the preset condition is:

$$80\%*R_{specification} \leq R \leq 120\%*R_{specification} \text{ and } 80\%*G_{specification} \leq G \leq 120*G_{specification},$$

where, $R_{specification}$ is a preset red gray-scale voltage threshold; and $G_{specification}$ is a preset green gray-scale voltage threshold.

Figure 8:
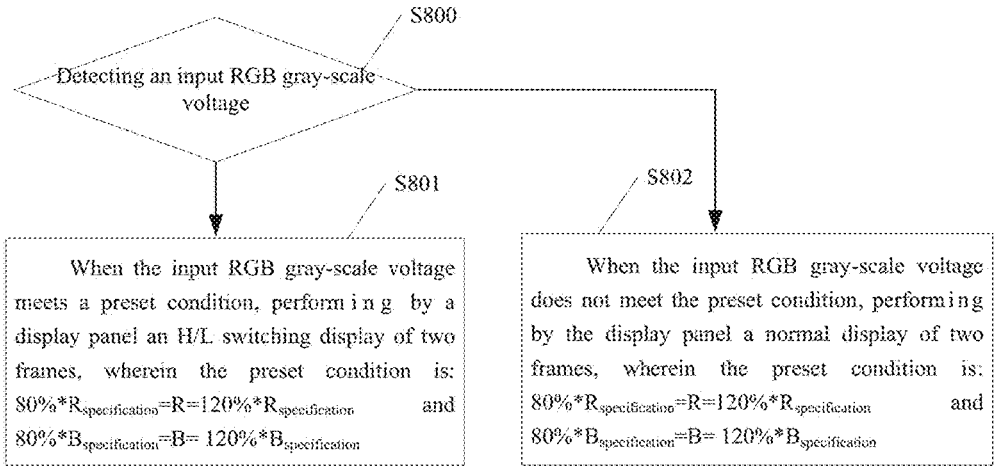

In FIG. 8, a method for improving an LCD large viewing angle display effect is introduced. The method comprises the following steps.

In step S800, an input RGB gray-scale voltage is detected.

In step S801, when the input RGB gray-scale voltage meets any preset condition, a display panel performs an H/L switching display of two frames, wherein the preset condition is:

$$80\%*R_{specification} \leq R \leq 120\%*R_{specification} \text{ and } 80\%*B_{specification} \leq B \leq 120*B_{specification},$$

where, $R_{specification}$ is a preset red gray-scale voltage threshold; and $B_{specification}$ is a preset blue gray-scale voltage threshold;

In step S802, when the input RGB gray-scale voltage does not meet the preset condition, the display panel performs a normal display of two frames, wherein the preset condition is:

$$80\%*R_{specification} \leq R \leq 120\%*R_{specification} \text{ and } 80\%*B_{specification} \leq B \leq 120*B_{specification},$$

where, $R_{specification}$ is a preset red gray-scale voltage threshold; and $B_{specification}$ is a preset blue gray-scale voltage threshold.

Figure 9:
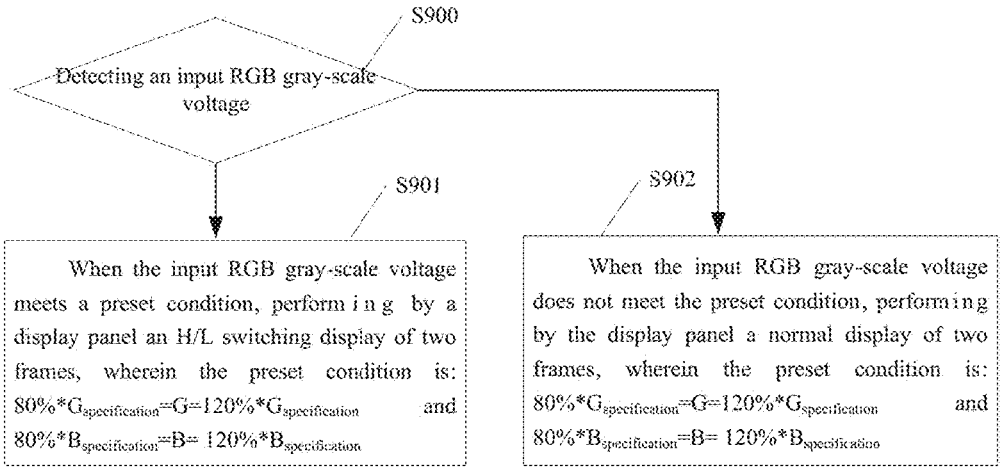

In FIG. 9, a method for improving an LCD large viewing angle display effect is to introduced. The method comprises the following steps.

In step S900, an input RGB gray-scale voltage is detected.

In step S901, when the input RGB gray-scale voltage meets any preset condition, a display panel performs an H/L switching display of two frames, wherein the preset condition is:

$$80\%*G_{specification} \leq G \leq 120\%*G_{specification} \text{ and } 80\%*B_{specification} \leq B \leq 120\%*B_{specification},$$

where, $G_{specification}$ is a preset green gray-scale voltage threshold; and $B_{specification}$ is a preset blue gray-scale voltage threshold;

In step S902, when the input RGB gray-scale voltage does not meet the preset condition, the display panel performs a normal display of two frames, wherein the preset condition is:

$$80\%*G_{specification} \leq G \leq 120\%*G_{specification} \text{ and } 80\%*B_{specification} \leq B \leq 120\%*B_{specification},$$

where, $G_{specification}$ is a preset green gray-scale voltage threshold; and $B_{specification}$ is a preset blue gray-scale voltage threshold.

Figure 10:
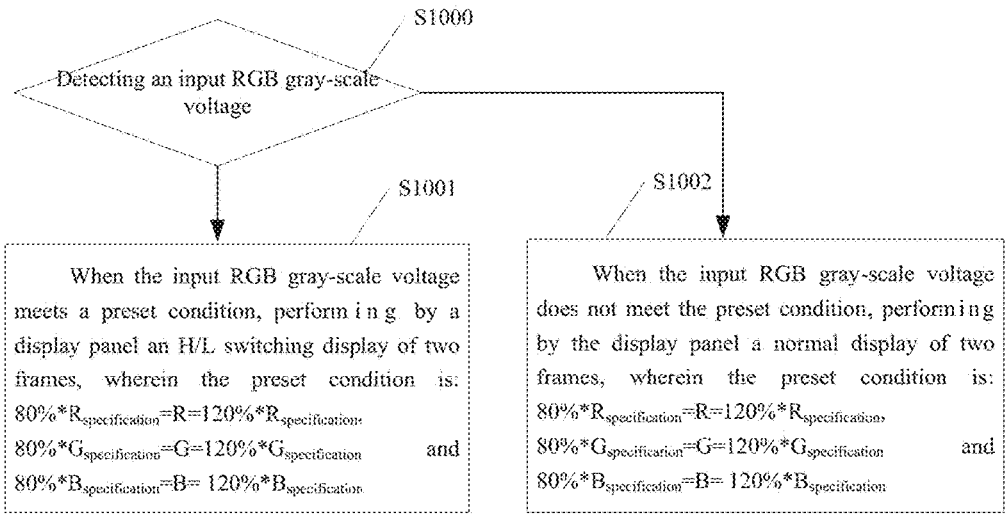

In FIG. 10, a method for improving an LCD large viewing angle display effect is introduced. The method comprises the following steps.

In step S1000, an input RGB gray-scale voltage is detected.

In step S1001, when the input RGB gray-scale voltage meets any preset condition, a display panel performs an H/L switching display of two frames, wherein the preset condition is:

$$80\%*R_{specification} \leq R \leq 120\%*R_{specification}, 80\%*G_{specification} \leq G \leq 120\%*G_{specification} \text{ and } 80\%*B_{specification} \leq B \leq 120\%*B_{specification},$$

where, $R_{specification}$ is a preset red gray-scale voltage threshold; $G_{specification}$ is a preset green gray-scale voltage threshold; and $B_{specification}$ is a preset blue gray-scale voltage threshold;

In step S1002, when the input RGB gray-scale voltage does not meet the preset condition, the display panel performs a normal display of two frames, wherein the preset condition is:

$$80\%*R_{specification} \leq R \leq 120\%*R_{specification}, 80\%*G_{specification} \leq G \leq 120\%*G_{specification} \text{ and } 80\%*B_{specification} \leq B \leq 120\%*B_{specification},$$

where, $R_{specification}$ is a preset red gray-scale voltage threshold; $G_{specification}$ is a preset green gray-scale voltage threshold; and $B_{specification}$ is a preset blue gray-scale voltage threshold.

Although the present disclosure has been described herein with reference to specific embodiments, it should be understood that these embodiments are merely examples of the principles and applications of the present disclosure. It should therefore be understood that numerous modifications may be made to the exemplary embodiments and that other arrangements may be designed as long as they do not deviate from the spirit and scope of the present disclosure as defined by the appended claims. It should be understood that, different dependent claims and the features described herein can be combined in a manner different from that described in the original claims. It is also understandable that the features described in connection with the individual embodiments may be used in other embodiments.

The invention claimed is:

1. A method for improving an LCD large viewing angle display effect, comprising steps of:

detecting an input RGB gray-scale voltage, when the input RGB gray-scale voltage meets a given preset condition, performing by a display panel an H/L switching display of two frames, and when the input RGB gray-scale voltage does not meet the given preset condition, performing by the display panel a normal display of two frames, wherein the given preset condition is: any one of $80\%*R_{specification} \leq R \leq 0.120*R_{specification}$, $80\%*G_{specification} \leq G \leq 120\%*G_{specification}$ and $80\%*B_{specification} \leq B \leq 120\%*B_{specification}$ constitutes a first preset mode, wherein, $R_{specification}$ is a preset red gray-scale voltage threshold; $G_{specification}$ is a preset green gray-scale voltage threshold; $B_{specification}$ is a preset blue gray-scale voltage threshold; R is an input red gray-scale voltage; G is an input green gray-scale voltage; and B is an input blue gray-scale voltage, wherein the given preset condition is: $80\%*R_{specification} \leq R \leq 120\%*R_{specification}$ and $80\%*G_{specification} \leq G \leq 0.120\%*G_{specification}$ and $80\%*B_{specification} \leq B \leq 120\%*B_{specification}$ constitute a second preset mode.

2. A device for improving an LCD large viewing angle display effect, comprising:

a voltage detecting unit, configured to detect an input RGB gray-scale voltage; and a switching display determination unit, configured to determine the input RGB gray-scale voltage so that when the input RGB gray-scale voltage meets a given preset condition, a display panel performs an H/L switching display of two frames, and when the input RGB gray-scale voltage does not meet the given preset condition, the display panel performs a normal display of two frames, wherein the given preset condition is: any one of $80\%*R_{specification} \leq R \leq 0.120*R_{specification}$, $80\%*G_{specification} \leq G \leq 120\%*G_{specification}$ and $80\%*B_{specification} \leq B \leq 120\%*B_{specification}$ constitutes a first preset mode, wherein, $R_{specification}$ is a preset red gray-scale voltage threshold; $G_{specification}$ is a preset green gray-scale voltage threshold; $B_{specification}$ is a preset blue gray-scale voltage threshold; R is an input red gray-scale voltage; G is an input green gray-scale voltage; and B is an input blue gray-scale voltage, wherein the given preset condition is: $80\%*R_{specification} \leq R \leq 120\%*R_{specification}$ and $80\%*G_{specification} \leq G \leq 0.120\%*G_{specification}$ and $80\%*B_{specification} \leq B \leq 120\%*B_{specification}$ constitute a second preset mode.

* * * * *